US011944253B2

(12) United States Patent
Gaus

(10) Patent No.: US 11,944,253 B2
(45) Date of Patent: Apr. 2, 2024

(54) CLEANING DEVICE AND METHOD FOR CLEANING ARTICLES TO BE CLEANED

(71) Applicant: MEIKO Maschinenbau Gmbh & Co. KG, Offenburg (DE)

(72) Inventor: Bruno Gaus, Offenburg (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 51 days.

(21) Appl. No.: 17/250,929

(22) PCT Filed: Oct. 4, 2019

(86) PCT No.: PCT/EP2019/076865
§ 371 (c)(1),
(2) Date: Mar. 29, 2021

(87) PCT Pub. No.: WO2020/070264
PCT Pub. Date: Apr. 9, 2020

(65) Prior Publication Data

US 2021/0338038 A1 Nov. 4, 2021

(30) Foreign Application Priority Data

Oct. 5, 2018 (DE) ..... 102018217052.5

(51) Int. Cl.
*A47L 15/24* (2006.01)
*A47L 15/00* (2006.01)

(52) U.S. Cl.
CPC ..... *A47L 15/245* (2013.01); *A47L 15/0028* (2013.01); *A47L 2401/04* (2013.01)

(58) Field of Classification Search
None
See application file for complete search history.

(56) References Cited

U.S. PATENT DOCUMENTS 3,486,939 A 12/1969 Pinckard
3,520,726 A 7/1970 Gay
(Continued)

FOREIGN PATENT DOCUMENTS

CN 104433988 A * 3/2015
CN 104433988 A 3/2015
(Continued)

OTHER PUBLICATIONS

PCT, Intl. App. No. PCT/EP2019/076865 Translation of International Preliminary Report on Patentability, 9 pages, dated Apr. 8, 2021.

(Continued)

*Primary Examiner* — Rita P Adhlakha
(74) *Attorney, Agent, or Firm* — Woodard, Emhardt, Henry, Reeves & Wagner, LLP

(57) ABSTRACT

The invention proposes a cleaning device (110) for cleaning washware (130). The cleaning device (110) comprises at least one cleaning chamber (114) with at least one application device (148) for applying at least one cleaning liquid (150) to the washware (130) in the cleaning chamber (114). The cleaning device (110) furthermore comprises at least one transportation device (136) for transporting the washware (130) through the cleaning chamber (114) in a transportation direction (138). The cleaning device (110) furthermore has at least one outlet region (142), which is arranged downstream of the cleaning chamber (114) in the transportation direction (138), for removing the washware (130) from the transportation device (136). The cleaning device (110) furthermore has at least one sensor (168) for identifying at least one prespecified type of washware (130). The cleaning device (110) furthermore has at least one slide (170) and is designed to automatically push the washware (Continued)

(130) of the prespecified type from the transportation device (136) transversely to the transportation direction (138).

17 Claims, 2 Drawing Sheets

(56) References Cited

U.S. PATENT DOCUMENTS

| | | | | |
|---|---|---|---|---|
| 5,507,877 | A | 4/1996 | Mgsig et al. | |
| 10,905,307 | B2 * | 2/2021 | Yoon | B25J 18/02 |
| 2007/0246071 | A1 | 10/2007 | Streb | |
| 2009/0183753 | A1 | 7/2009 | Maennle et al. | |
| 2010/0043834 | A1 * | 2/2010 | Scheringer | A47L 15/241 134/25.2 |
| 2010/0132735 | A1 | 6/2010 | Gaus et al. | |
| 2014/0041688 | A1 | 2/2014 | Maennle et al. | |

FOREIGN PATENT DOCUMENTS

| | | | | | |
|---|---|---|---|---|---|
| DE | 4339111 | A1 | | 5/1994 | |
| DE | 102004049392 | A1 | | 4/2006 | |
| DE | 102004056052 | A1 | | 6/2006 | |
| DE | 102007025263 | A1 | | 10/2007 | |
| DE | 102012203839 | A1 | | 9/2012 | |
| DE | 102012203839 | A1 | * | 9/2013 | A47L 15/0092 |
| DE | 102017121978 | A1 | | 11/2017 | |
| EP | 2510863 | A1 | | 10/2012 | |
| EP | 2825086 | B1 | | 10/2017 | |
| GB | 2155772 | A | | 10/1985 | |
| JP | H06135549 | A | | 5/1994 | |
| JP | H079826 | U | | 2/1995 | |
| JP | 2594959 | Y | | 5/1999 | |
| JP | 2006188309 | A | | 7/2006 | |
| JP | 2013188423 | A | * | 9/2013 | |
| JP | 3191641 | U | | 7/2014 | |
| WO | 2013138173 | A1 | | 9/2013 | |
| WO | 2018034251 | A1 | | 2/2018 | |

OTHER PUBLICATIONS

JP, JP App. No. 2021-158626 Office Action dated Jun. 6, 2023, 12 pages, Jun. 6, 2023.

PCT, Intl. App. No. PCT/EP2019/076865 International Search Report with English Translation, 6 pages, dated Jan. 7, 2020.

PCT, Intl. App. No. PCT/EP2019/076865 Written Opinion of the International Searching Authority, 7 pages, dated Jan. 7, 2020.

JP, JP App. No. 2021-158626 Final Office Action- Translation—dated Nov. 14, 2023, 8 pages, Nov. 14, 2023.

* cited by examiner

CLEANING DEVICE AND METHOD FOR CLEANING ARTICLES TO BE CLEANED

TECHNICAL FIELD

The invention relates to a cleaning device and to a method for cleaning washware. Cleaning devices and methods of said type can be used, for example, in the field of dishwashing, in particular in the field of commercial dishwashing. The invention can be used, in particular, in large kitchens in which large quantities of washware, such as trays, crockery and cutlery, have to be cleaned. However, other fields of use are also conceivable in principle.

TECHNICAL BACKGROUND

A large number of cleaning devices, also called cleaning apparatuses, which can clean and/or disinfect washware are known from the prior art. The design of these cleaning devices depends on the whole to a great extent on the various boundary conditions, such as for example the type of washware to be cleaned, the degrees of soiling, the throughput and similar conditions. By way of example, reference can be made to cleaning devices which are described, for example, in DE 10 2004 056 052 A1 or in DE 10 2007 025 263 A1.

In many cases, cleaning devices are combined with transportation devices or transportation systems in large kitchens in order to automatically transport the washware to and/or fro. For example, cleaning systems in which trays carrying soiled crockery and cutlery are placed onto a conveyor belt are provided in many facilities for mass catering, such as for example canteens in schools, hospitals or other facilities in which large numbers of people are catered for. The washware is transported by said conveyor belt to the actual cleaning device, such as a dishwasher for example. There, the washware is generally further sorted by staff, waste is disposed of and crockery, cutlery and trays are fed in a suitable manner to the cleaning device, for example a flight-type dishwasher, a rack conveyor dishwasher, a hood-type dishwasher or else a pass-through dishwasher. Furthermore, after cleaning, the cleaned washware is generally manually sorted, for example at a so-called outlet of the cleaning device, and fed to corresponding transportation devices or storing devices, such as for example a tray trolley or a plate trolley.

One technical and also organizational challenge faced in many cases is that of the soiled washware not occurring in a uniform manner. In particular, on account of group dynamics, schedules or else other circumstances which do not lie in the area of influence of the large kitchen, load peaks often occur, but equally also times at which there is only a small amount of washware or no washware at all. This creates considerable challenges in respect of planning for staff requirements and also for planning the configuration of the cleaning device. For example, the configuration of the system and planning for staff generally have to be configured such that the staff can manage the load peaks but, under certain circumstances, this leads to inadequate utilization of the staff outside the load peaks. The planning for staff and also the configuration of the cleaning device therefore have to be overdesigned in many cases.

DE 10 2017 121 978 A1 describes a washer in the form of a commercial utensil washer or dishwasher which is designed as a batch dishwasher and is embodied as a hood-type or pass-through dishwasher and has a treatment chamber with at least one wash system which is designed as a recirculation system. In order to be able to optimize the capacity of the machine that can actually be implemented, specifically while at the same time easing the burden on the dishwashing staff, the invention provides that the dishwasher has an associated loading/unloading device for preferably selectively automatically loading the treatment chamber with washware and/or for preferably selectively automatically unloading washware from the treatment chamber.

DE 4339111 A1 describes a dishwasher. In order permanently to reduce the consumption of water, energy and dishwashing detergent, the crockery in the individual dish racks is washed cyclically, wherein the circuits of the dishwashing device are started up only in their respective time interval within the wash program. In so doing, a conveyor belt for the dish racks is actuated by means of corresponding switches in such a way that the crockery remains in the region of a wash zone during the wash process.

DE 10 2004 049 392 A1 describes a method for transporting washware through a conveyor dishwasher and onto a conveyor dishwasher. The conveyor dishwasher comprises a wash zone, a final rinse zone and a drying zone. The washware is cleaned in the wash zone, rinsed in the final rinse zone and dried in the drying zone. Transportation devices with which the washware is transported in the conveying direction at a transportation rate which is optimal for the process steps taking place in the respective zones are provided.

In spite of the advantages achieved with these devices and methods, the above-described technical and organizational challenge generally remains. For example, in customary cleaning systems, the transportation devices are often inflexible, and generally not able to adapt to the various boundary conditions, in particular to sudden load peaks, to backlogs in loading or in unloading, or else to changing requirements in respect of the type of soiling or the washware which occurs. Therefore, at peak loads, only the transportation rate of the transportation device can generally be adjusted, for example by way of transportation being slowed down or stopped entirely. If, for example, a backlog of the cleaned washware forms at the outlet of the cleaning device, the entire cleaning system generally has to be stopped. These measures then generally affect the entire cleaning system. Therefore, as before, the staff planning for many cleaning systems also has to be dimensioned such that a peak load can always be managed. This reserve of staff and generally also machine overcapacity can lead to unnecessary additional costs in the acquisition of and during operation of the cleaning device.

OBJECT OF THE INVENTION

Therefore, it would be desirable to provide a cleaning device and a method for cleaning washware, in particular washware in the field of large kitchens, which at least largely avoid the disadvantages of known devices and methods of said type. In particular, the aim of the cleaning device and the method is to render possible more flexible staff planning in respect of operating staff and more flexible configuration of the devices and preferably reduce the use of operating staff.

DISCLOSURE OF THE INVENTION

This object is addressed by a cleaning device and a method for cleaning washware, having the features of the independent patent claims. Advantageous embodiments which can be implemented on their own or in any desired combination are presented in the dependent claims.

In the text which follows, the terms "exhibit", "have", "comprise" or "include" or any grammatical departures therefrom are used non-exclusively. Accordingly, these terms can refer either to situations in which, besides the features introduced by these terms, no further features are present, or to situations in which one or more further features are present. For example, the expression "A exhibits B", "A has B", "A comprises B" or "A includes B" can refer either to the situation in which, apart from B, no further element is present in A (i.e. to a situation in which A exclusively consists of B), or to the situation in which, in addition to B, one or more further elements are present in A, for example element C, elements C and D or even further elements.

Furthermore, it should be noted that the terms "at least one" and "one or more" and grammatical modifications of these terms, if they are used in association with one or more elements or features and are intended to express the fact the element or feature can be provided singularly or multiply, generally are used only once, for example when the feature or element is introduced for the first time. When the feature or element is subsequently mentioned again, the corresponding term "at least one" or "one or more" is generally no longer used, without restricting the possibility that the feature or element can be provided singularly or multiply.

Furthermore, in the text which follows, the terms "preferably", "in particular", "for example" or similar terms are used in conjunction with optional features, without alternative embodiments being restricted thereby. In this regard, features which are introduced by these terms are optional features, and the scope of protection of the claims, and in particular of the independent claims, is not intended to be restricted by these features. In this regard, the invention, as will be recognized by the person skilled in the art, can also be carried out using other configurations. In a similar way, features which are introduced by "in one embodiment of the invention" or by "in one exemplary embodiment of the invention" are understood as optional features, without alternative configurations or the scope of protection of the independent claims being intended to be restricted thereby. Furthermore, all possibilities of combining the features introduced by these introductory expressions with other features, be they optional or non-optional features, are intended to remain unaffected by these introductory expressions.

A first aspect of the present invention proposes a cleaning device for cleaning washware. The term "cleaning device" as it is used here is a broad term which is to be accorded its usual and common meaning as it is understood by a person skilled in the art. The term is not restricted to a specific or adapted meaning. The term may, without restriction, refer in particular to a device which is designed to free washware of adhering macroscopic and also microscopic soiling or to at least partially remove soiling of this type. In addition, a disinfecting effect can optionally be exerted. As explained in more detail below, the cleaning device can be configured, in particular, as a washer, in particular as a dishwasher. In this case, the washer can be configured, for example, as a single-chamber washer, in particular as a commercial single-chamber dishwasher with a multi-circuit dishwashing system, or else as a conveyor dishwasher, in particular as a flight-type dishwasher and/or as a rack conveyor dishwasher. Examples will be explained in more detail below.

The term "washware" as it is used here is a broad term which is to be accorded its usual and common meaning as it is understood by a person skilled in the art. The term is not restricted to a specific or adapted meaning. The term may, without restriction, refer in particular to any articles which can be cleaned by means of the cleaning device. In this case, one article can be cleaned, or a plurality of articles can be cleaned at the same time or sequentially. In particular, the washware may be articles which are used directly or indirectly for preparing, storing or serving food, that is to say for example crockery, cutlery, trays, bowls, glassware, pots, pans or similar articles. Accordingly, the cleaning device can be configured, in particular, as a dishwasher, for example as a dishwasher for commercial use in large kitchens or kitchens for mass catering. Other refinements of the washware are also possible in principle.

The cleaning device comprises at least one cleaning chamber with at least one application device for applying at least one cleaning liquid to the washware in the cleaning chamber. The term "cleaning chamber" as it is used here is a broad term which is to be accorded its usual and common meaning as it is understood by a person skilled in the art. The term is not restricted to a specific or adapted meaning. The term may, without restriction, refer in particular to a fully or partly closed chamber, within which the cleaning process can be performed in full or in part. The cleaning chamber can in particular have at least one housing which fully or partially surrounds the cleaning chamber. Here, a single cleaning chamber can be provided, or in principle a plurality of cleaning chambers can be provided, for example sequentially. The cleaning chamber can have for example at least one opening for loading the cleaning chamber with the washware. For example, said opening can be an opening with a hatch which is arranged on a front side of the cleaning chamber and/or a top side of the cleaning chamber. As an alternative, hoods are also possible for closing the cleaning chamber, for example within the scope of what are known as hood-type dishwashers. Once again as an alternative, the cleaning chamber can also be for example wholly or partially configured as a tunnel, for example within the scope of what are known as pass-through dishwashers or conveyor dishwashers, for example as a tunnel with an inlet opening and an outlet opening. Other refinements are also possible in principle.

The term "application device" as it is used here is a broad term which is to be accorded its usual and common meaning as it is understood by a person skilled in the art. The term is not restricted to a specific or adapted meaning. The term may, without restriction, refer in particular to basically any desired device by means of which the cleaning liquid can be applied to the washware within the cleaning chamber. The application device can in particular comprise, as is explained in more detail below, at least one nozzle system. Furthermore, the application device can comprise at least one pump, and also at least one line system, for providing cleaning liquid to the nozzle system. For example, one nozzle system and one line system for applying cleaning liquid from a tank, and also at least one corresponding pump, can be provided here. As an alternative or in addition, cleaning liquid can also be applied for example to at least one nozzle system directly from a feed line, without a pump being required for this purpose. One or more cleaning zones, through which the washware passes sequentially for example, can be provided in the cleaning device. For example, a single cleaning zone can be provided, wherein the cleaning device is designed to carry out a cleaning program, in which the washware is held stationary in the cleaning chamber and cleaning liquid is applied to said washware in succession in one or more cleaning steps of the cleaning program in different ways, by means of the application device. As an alternative, the washware can also be conveyed in succession through a plurality of cleaning zones in which cleaning liquid is applied in different ways, for example one or more cleaning zones selected from the group consisting of: a pre-clearing zone; a wash zone, a rinse or final rinse zone, wherein said rinse or final rinse zone can be subdivided into a pump final rinse zone and a downstream fresh water final rinse zone. Furthermore, at least one drying step can be provided, which drying step for example can follow the application of the cleaning liquid in the one chamber in the case of the washware being held stationary or which drying step can take place in a drying zone which is downstream of the liquid cleaning zones in the case of the conveyor dishwasher for example.

The term "cleaning liquid" as it is used here is a broad term which is to be accorded its usual and common meaning as it is understood by a person skilled in the art. The term is not restricted to a specific or adapted meaning. The term may, without restriction, refer in particular to a liquid which can provide a cleaning effect when it makes contact with the washware. In particular, the cleaning liquid can comprise an aqueous liquid, for example water and/or water containing one or more additives, for example containing one or more detergent concentrates and/or final rinse agents and/or disinfectants. The cleaning device can be designed to use a single cleaning liquid or else to use a combination of a plurality of cleaning liquids. If a plurality of cleaning liquids are provided, the different cleaning liquids can be applied to the washware at the same time or else sequentially. For example, the washware can remain stationary within the cleaning chamber and the different cleaning liquids and/or cleaning fluids can be applied to said washware in succession. As an alternative, the washware, as explained above, can also be conveyed sequentially through a plurality of cleaning zones in which for example different types of cleaning liquid and/or cleaning liquids of different grades of purity are applied to said washware. Different grades of purity can be generated for example by a cascade overflow between different tanks of the cleaning device, wherein a degree of purity preferably increases in the transportation direction. As an alternative or in addition, pumped systems which regulate the liquid balance and the degree of purity between the individual tanks of the cleaning device are also known and can be used within the scope of the invention.

The cleaning device furthermore comprises at least one transportation device for transporting the washware through the cleaning chamber in a transportation direction. The term "transportation device" as it is used here is a broad term which is to be accorded its usual and common meaning as it is understood by a person skilled in the art. The term is not restricted to a specific or adapted meaning. The term may, without restriction, refer in particular to a device which is designed to transport at least one other device or at least one other element and/or to drive a movement of the other device or of the other element. The transportation device can in particular comprise at least one drive element, for example at least one drive element which runs in a circuit through the cleaning chamber. In particular, the transportation device, for example the drive element, can comprise at least one element selected from the group consisting of: a drive chain; a drive belt; a conveyor belt. The transportation device can also be designed to transport washware indirectly, for example in racks. In this case, the racks can be placed for example on sliding rails and conveyed for example by means of a reversing pawl transportation system. Other types of devices for indirect transportation, for example by means of racks, are also conceivable and usable. Here, the transportation can take place for example continuously or else intermittently or in a clocked manner, so that for example continuously operating conveyor dishwashers or else clocked dishwashers, such as pass-through dishwashers for example, can be used. The transportation direction can be for example a main direction of a movement of the washware within the cleaning chamber. The transportation direction can be permanently prespecified or can also change, for example locally or else with respect to time. For example, the transportation direction can be directed from an inlet of the cleaning chamber to an outlet.

The cleaning device furthermore has at least one outlet region, which is arranged downstream of the cleaning chamber in the transportation direction, for removing the washware from the transportation device. The term "outlet region" as it is used here is a broad term which is to be accorded its usual and common meaning as it is understood by a person skilled in the art. The term is not restricted to a specific or adapted meaning. The term may, without restriction, refer in particular to a region, for example a spatial section, of the cleaning device in which the cleaned washware is accessible to operating staff and/or an automatic removal machine and can be manually and/or automatically removed from the cleaning device. For example, the outlet region can have an accessible region of the transportation device, for example a region which is arranged downstream of the cleaning chamber and in particular of the cleaning tunnel and into which in particular the washware can be transported after being cleaned in the cleaning chamber. Said region may be for example an uncovered region into which the transportation device, for example the conveyor belt, projects. In general here, the term "arranged downstream" or "arranged downstream in the transportation direction" can refer in particular to the washware initially passing the cleaning chamber and then being transported into the outlet region in the transportation direction.

The cleaning device furthermore has at least one sensor for identifying at least one prespecified type of washware. The term "sensor" as it is used here is a broad term which is to be accorded its usual and common meaning as it is understood by a person skilled in the art. The term is not restricted to a specific or adapted meaning. The term may, without restriction, refer in particular to a device which is designed to detect at least one property of another device, of a substance or of an environment, for example at least one physical, chemical or biological property. The sensor can comprise, as is explained in more detail below, in particular at least one optical sensor, for example at least one camera. In particular, the sensor can have at least one camera with at least one image identification system, for example at least one data processing device with a program-based set up for identification. For example, the sensor can have at least one self-learning system in order to identify the at least one prespecified type of washware. However, as an alternative or in addition, other types of sensors can also be used, for example mechanical sensors. The term "identification" can in particular be understood to mean that the sensor is designed to distinguish at least one type of washware from other articles or other types of washware. For example, the sensor can be designed to distinguish trays from other types of washware. In particular, the sensor can be designed in a program-based manner to generate at least one item of information, for example at least one signal and/or at least one item of digital information, which contains information as to whether the at least one prespecified type of washware has been identified or not. For example, tray identification can take place in a targeted manner. The sensor can also be wholly or partially combined with a controller of the cleaning device. For example, the sensor can comprise at least one sensor element, for example at least one camera and/or at least one camera chip, and also for example a controller of the cleaning device or a part of said controller, for example at least one data processing device, in particular at least one processor of the controller. The controller can be designed for example to take over the task of image identification by means of which the at least one type of washware is identified in the single image or in a sequence of images which can be provided by the camera.

The cleaning device furthermore has at least one slide. The cleaning device is designed to automatically push the washware of the prespecified type from the transportation device transversely to the transportation direction. The term "slide" as it is used here is a broad term which is to be accorded its usual and common meaning as it is understood by a person skilled in the art. The term is not restricted to a specific or adapted meaning. The term may, without restriction, refer in particular to a device or an element which is designed to displace another device or another element. In particular, the slide can be wholly or partially designed as an actuator, that is to say as an element which mechanically acts on another element, for example so as to change its location and/or position. In particular, the slide can have at least one actuator selected from the group consisting of: a mechanical actuator; an electromechanical actuator; a hydraulic or pneumatic slide; an on at least one rail-mounted displaceable element; a tappet. For example, the slide can have a base which is arranged on a first side of the transportation device and/or is arranged above the transportation device, wherein a movable actuator element extends from the base over the transportation device, which actuator element is designed to automatically push the washware of the prespecified type from the transportation device, for example the conveyor belt, to a second side of the transportation device which is situated opposite the first side.

The term "automatic" as it is used here is likewise a broad term which is to be accorded its usual and common meaning as it is understood by a person skilled in the art. The term is not restricted to a specific or adapted meaning. The term may, without restriction, refer in particular to a process which takes place without human intervention. In particular, the cleaning device can be designed in such a way, for example by corresponding program-based set up of a controller of the cleaning device and/or of the sensor itself, that, as soon as an item of washware of the at least one prespecified type, for example a tray, is identified, an action of the slide, by way of which the slide automatically pushes the at least one item of washware of the prespecified type identified by the sensor from the transportation device transversely to the transportation direction, is initiated without further intervention by a human user, for example exclusively on the basis of a corresponding control operation.

In general, the slide can be designed to automatically push the washware of the prespecified type from the transportation device transversely to the transportation direction. Here, the expression "transversely" can include in particular a pushing direction of the slide at an angle of 90° in relation to the transportation direction. However, deviations from 90° are possible in principle, preferably deviations of not more than 20°, in particular of not more than 10° or even not more than 5°.

The cleaning device can furthermore have at least one receiving device which is arranged next to the transportation device transversely to the transportation direction. In this context, the term "next to the transportation device transversely to the transportation direction" can in particular be understood to mean that the receiving device is arranged next to the transportation device, so that the washware can be transported through the transportation device past the receiving device. The transportation device can in particular be configured in a linear manner at least in sections, so that linear transportation past the receiving device can take place. Washware can be displaced from the transportation device onto the or into the receiving device by way of a movement transverse to the transportation direction, for example at an angle of 90° in relation to the transportation direction, preferably with a deviation of not more than 20°, in particular of not more than 10° or even not more than 5°.

The term "receiving device" as it is used here is a broad term which is to be accorded its usual and common meaning as it is understood by a person skilled in the art. The term is not restricted to a specific or adapted meaning. The term may, without restriction, refer in particular to a device which can receive one or more other elements. For example, the receiving device can comprise a storing means in which a plurality of identical elements can be received in a reversible manner. In particular, the receiving device can have, as is explained in more detail below, at least one receiving device for trays and/or at least one receiving device for a specific type of crockery, for example plates, and/or at least one receiving device for cutlery. The receiving device can have for example at least one stacker for stacking the washware, for example at least one tray stacker. The cleaning device can furthermore have, as is explained in more detail below, at least one guide, for example one guide with at least one guide element, wherein the guide is designed to feed the washware of the prespecified type to the receiving device with at least one prespecified orientation, for example for the purpose of stacking with a uniform orientation for all started items of washware of the prespecified type. The guide can be designed in particular wholly or partially separately from the at least one receiving device.

The cleaning device can be designed in particular to push the washware of the prespecified type onto the receiving device by means of the slide. If the presence of at least one item of the at least one prespecified type of washware is identified, for example by the sensor, on its own or with assistance by at least the at least one optional controller, for example within an identification region of the sensor, the slide can be actuated in such a way, for example by the controller, that the identified item of the prespecified type or else a plurality of identified items of the prespecified type are pushed onto the receiving device by the slide.

The receiving device can in particular be designed in such a way that the washware of the prespecified type, for example a plurality of items of the washware of the prespecified type, can be stacked in the receiving device. As explained above, the receiving device can accordingly have for example at least one tray stacker and/or at least one stacker for crockery and/or cutlery. Other types of stacking device are also possible.

The cleaning device, for example the receiving device and/or another part of the cleaning device, can furthermore have at least one guide which can be designed to feed the washware of the prespecified type to the receiving device with a prespecified orientation. For example, the guide can comprise at least one guide rod and/or at least one guide rail. During the pushing process, before the washware reaches its final position in the receiving device, the guide can change an orientation of the washware, for example by way of a correspondingly shaped bend in the guide. In general, the guide can be designed for example to turn the washware of the prespecified type from a first orientation on the transportation device to a second orientation in the receiving device, wherein the first and the second orientation preferably differ. For example, flat washware can be received upright in the cleaning device on the transportation device and can be transferred by the guide to a horizontal orientation in the receiving device. In this way, space-saving orientations can be selected both in the cleaning device and also in the receiving device. The at least one guide can wholly or partially be a constituent part of a dishwasher of the cleaning device, can be wholly or partially a constituent part of the receiving device or can also be wholly or partially another constituent part of the cleaning device, for example as a separate component. For example, standard components, for example a tray stacker, can be used as the receiving device, wherein the at least one guide can be designed for example wholly or partially separately from the receiving device.

In particular, the transportation device can have at least one device selected from the group consisting of: a conveyor belt; a transportation chain; a roller transportation device; a pawl drive. In particular, the cleaning device can accordingly be configured for example as a conveyor dishwasher, for example as a flight-type dishwasher or as a rack conveyor dishwasher. However, other refinements are also possible in principle. In particular, the conveyor belt can have, as is explained in more detail below, a plurality of fingers or transportation fingers into which the washware or a portion of the washware can be inserted upright in order to in this way create a space-saving arrangement on the transportation device. For example, trays can be received upright in the fingers, for example with a long edge which faces the transportation device. When it is pushed out, the tray can slide for example on the long edge over the transportation device, for example the conveyor belt.

In particular, the cleaning device can be configured in such a way that only washware of the prespecified type is pushed from the transportation device transversely to the transportation direction by the slide, whereas for example other types of washware remain on the transportation device. For example, only trays can be pushed from the transportation device, whereas for example crockery and/or cutlery remains on the transportation device.

In general, the washware of the prespecified type can therefore in particular comprise trays. In particular, the transportation device can in general be designed to receive the trays with a non-parallel orientation in relation to the plane of the transportation device. As explained above, this can take place for example by way of the tray being upright on the transportation device, for example the conveyor belt, for example with an orientation in relation to the plane of the transportation device of 90° or a deviation from 90° of not more than 30°, in particular of not more than 20°. In particular, the transportation device can have a conveyor belt and/or a link chain. In particular, the transportation device can have a plurality of receiving fingers, wherein the trays can be inserted into the receiving fingers at an angle of 60° to 120° in relation to a plane of the conveyor belt and/or of the link chain. In particular, the trays can be inserted into the receiving fingers transversely to the transportation direction, for example by way of a long edge of the trays being at an angle of 90°±20° in relation to the transportation direction.

In particular, the cleaning device, in particular the receiving device, can have at least one tray stacker. This tray stacker can be of mobile configuration for example, for example as a mobile tray stacking trolley. In particular, the tray stacker can have a spring-mounted platform for loading. In particular, the cleaning device can have at least one first guide rail and at least one second guide rail, wherein the first and the second guide rail are designed to hold a tray upright for a first section as it is pushed out from the conveyor belt and then to tip it, so that the tray tips onto a stack of trays. In particular, the at least one first guide rail and the at least one second guide rail can be designed wholly or partially separately from the receiving device. However, as an alternative or in addition, said first guide rail and second guide rail can also be wholly or partially integrated into the receiving device, for example into the tray stacker.

As explained above, the cleaning device can in general furthermore have in particular at least one controller. The term "controller" as it is used here is a broad term which is to be accorded its usual and common meaning as it is understood by a person skilled in the art. The term is not restricted to a specific or adapted meaning. The term may, without restriction, refer in particular to a unipartite or multipartite device of the cleaning device which is designed to wholly or partially control and/or to regulate operation of the cleaning device. In particular, the controller can be designed to change, in particular to control and/or to regulate, one or more operating parameters of the cleaning system, for example at least one temperature, at least one pressure, at least one heating capacity, at least one transportation rate or else a combination of two or more of said operating parameters. In particular, the controller can comprise at least one data processing device, for example at least one processor. In particular, the controller can be set up in a program-based manner, for example in order to control at least one cleaning program of the cleaning device and also optionally in order to control or to carry out the proposed method in one or more of the refinements mentioned below. The set-up of the controller can be wholly or partially realized by hardware or/also, as an alternative or in addition, wholly or partially by software. Furthermore, the controller can comprise at least one volatile and/or non-volatile data memory. Furthermore, the controller can comprise at least one interface, for example a man/machine interface for inputting commands and/or for outputting information, and/or a wireless or wired interface for unidirectional or bidirectional exchange of data and/or commands between the cleaning device and at least one further device. In particular, the controller can comprise at least one computer and/or at least one processor. In particular, the controller can be a centralized or decentralized machine controller of the cleaning device. In particular, the controller can be set up in a program-based manner in order to control operation of the transportation device and/or of the slide. Furthermore, the controller can also be connected to the at least one sensor and process for example one or more sensor signals in a program-based manner. Furthermore, the controller can, as explained above, also be wholly or partially identical to other elements and/or wholly or partially integrated into other elements. For example, the at least one sensor can be wholly or partially integrated into the controller too, for example by way of image identification of the sensor being integrated into the controller.

As explained above, the controller can be set up in particular in a program-based manner in order to control operation of the cleaning device. In particular, the controller can be designed to automatically actuate the slide when washware of the at least one prespecified type is identified and to automatically push this washware from the transportation device, for example onto the receiving device, transversely to the transportation direction.

In particular, the controller can be designed to identify the prespecified type of washware on the basis of data from the sensor and to actuate the slide in a corresponding manner. For example, the controller can have, as explained above, at least one image identification means which identifies whether washware of the at least one prespecified type is present, for example in an identification region of the sensor. If this is the case, the controller can for example actuate the slide in such a way that this identified washware is pushed from the transportation device onto the stacking device.

As mentioned above, the sensor can employ different sensor principles. In particular, the sensor can comprise at least one sensor selected from the group consisting of: a camera; a light barrier; a button; a switch, in particular an electromechanical switch; a mechanical-pneumatic switch; a tilting lever. Said sensor can also comprise other sensors, for example one or more proximity sensors or similar devices.

As explained above, the washware of the at least one prespecified type is pushed transversely from the transportation device, for example onto the receiving device, transversely to the transportation direction by means of the slide. The remaining washware can be treated in another way. For example one or more further slides can be provided for this purpose. As an alternative or in addition, one or more gripping devices can be provided in order to remove the washware from the transportation device. Once again as an alternative or in addition, one or more transfer devices can be provided at one end of the outlet region, for example at an end of the outlet region that is furthest away from the cleaning chamber. For example, the at least one transfer device can be designed to automatically remove washware other than the washware of the prespecified type from the transportation device. For example, the transfer device can have at least one device selected from the group consisting of a gripping means, a suction means, a chute, a conveyor belt, a transportation chain, a plate conveying belt, a belt conveying device.

Further possible refinements relate to the type of cleaning device and its possibilities. In particular, the cleaning device can comprise at least one dishwasher. In particular, the dishwasher can be selected from the group consisting of: a rack conveyor dishwasher, a flight-type dishwasher, a hood-type dishwasher, a pass-through dishwasher.

As explained above, the cleaning chamber can be configured in particular at least partially as a cleaning tunnel. In particular, the cleaning device can have at least two cleaning zones in the cleaning tunnel. In particular, the transportation device can be designed to transport the washware sequentially through the cleaning zones. In particular, the cleaning zones can comprise at least two zones selected from the group consisting of: a pre-clearing zone, a wash zone, a pump final rinse zone, a fresh water final rinse zone; a drying zone.

A further aspect proposes a method for cleaning washware. The method comprises the steps mentioned in more detail below. These steps can be carried out in said order. However, a different order is also possible in principle. Furthermore, two or more of said method steps can be carried out in an overlapping manner with respect to time or at the same time. Furthermore, one or more of said method steps can be carried out once or else repeatedly. In addition to said steps, the method can comprise further method steps which are not mentioned.

The method comprises the following steps:

I. providing a cleaning device as claimed in one of the preceding claims;

II. receiving the washware on the transportation device;

III. transporting the washware through the cleaning chamber in the transportation direction;

IV. applying at least one cleaning liquid to the washware in the cleaning chamber by means of the application device;

V. identifying at least one prespecified type of washware using the at least one sensor; and VI. pushing the washware of the prespecified type out of the transportation device transversely to the transportation direction by means of the slide.

The method comprises the use of the proposed cleaning device in one or more of the presented refinements. Accordingly, reference can be made to the description of the cleaning device for possible definitions and options.

In general, the described cleaning device and the proposed method have numerous advantages over known devices and methods of said type. In particular, the above-described technical challenges of known systems and methods are addressed. As explained, by way of automatically pushing one or more specific types of washware transversely to the transportation direction, specific items of this washware are automatically collected after cleaning and for example stacked. In particular, this option is advantageous for treating trays since trays can firstly be transported upright through the cleaning chamber in a space-saving manner and can be efficiently cleaned there in this way and secondly can be automatically destacked after cleaning. The construction of the slide can also be combined with other devices which automatically remove cleaned washware from the transportation device, for example out of the outlet region. For example, removal can take place by means of one or more gripping means or suction means, and/or removal can take place at one end of the transportation device, for example at one belt end, for example by way of remaining washware such as cutlery automatically dropping into a transportation box. For example, trays can be removed from the outlet region by the described slide, dishes can be removed by means of at least one gripping means and/or at least one suction means, and cutlery can for example automatically drop into cutlery boxes or else can be removed magnetically for example. Other options are also feasible. Furthermore, semi-automatic removal devices in which the at least one described slide is combined with human labor are also conceivable, wherein for example a reduced staffing level is possible in this case. Overall, for example a higher degree of flexibility in respect of the configuration of the cleaning device and also in respect of planning for operating staff can also be achieved in general owing to the automation or semi-automation.

In summary, without restriction of further possible configurations, the following embodiments are proposed:

Embodiment 1: A cleaning device for cleaning washware, comprising at least one cleaning chamber with at least one application device for applying at least one cleaning liquid to the washware in the cleaning chamber, furthermore comprising at least one transportation device for transporting the washware through the cleaning chamber in a transportation direction, wherein the cleaning device has at least one outlet region, which is arranged downstream of the cleaning chamber in the transportation direction, for removing the washware from the transportation device, wherein the cleaning device furthermore has at least one sensor for identifying at least one prespecified type of washware, wherein the cleaning device furthermore has at least one slide and is designed to automatically push the washware of the prespecified type from the transportation device transversely to the transportation direction.

Embodiment 2: The cleaning device according to the preceding embodiment, furthermore comprising at least one receiving device which is arranged next to the transportation device transversely to the transportation direction, wherein the cleaning device is designed to push the washware of the prespecified type onto the receiving device by means of the slide.

Embodiment 3: The cleaning device according to the preceding embodiment, wherein the washware of the prespecified type can be stacked in the receiving device.

Embodiment 4: The cleaning device according to one of the two preceding embodiments, wherein the cleaning device furthermore has at least one guide, wherein the guide is designed to feed the washware of the prespecified type to the receiving device with a prespecified orientation.

Embodiment 5: The cleaning device according to the preceding embodiment, wherein the guide is designed to turn the washware of the prespecified type from a first orientation on the transportation device to a second orientation in the receiving device.

Embodiment 6: The cleaning device according to one of the preceding embodiments, wherein the transportation device has at least one device selected from the group consisting of: a conveyor belt; a transportation chain; a roller transportation device; a pawl drive.

Embodiment 7: The cleaning device according to one of the preceding embodiments, wherein the washware of the prespecified type comprises trays.

Embodiment 8: The cleaning device according to the preceding embodiment, wherein the transportation device is designed to receive the trays with a non-parallel orientation in relation to a plane of the transportation device.

Embodiment 9: The cleaning device according to the preceding embodiment, wherein the transportation device has a conveyor belt and/or a link chain, wherein the transportation device has a plurality of receiving fingers, wherein the trays can be inserted into the receiving fingers at an angle of from 60° to 120° in relation to a plane of the conveyor belt and/or the link chain.

Embodiment 10: The cleaning device according to the preceding embodiment, wherein the trays can be inserted into the receiving fingers transversely to the transportation direction.

Embodiment 11: The cleaning device according to one of the four preceding embodiments, wherein the cleaning device has at least one tray stacker, in particular a mobile tray stacking trolley, in particular with a spring-loaded platform for loading.

Embodiment 12: The cleaning device according to the preceding embodiment, wherein the cleaning device has at least one first guide rail and at least one second guide rail, wherein the first and the second guide rail are designed to hold a tray upright for a first section as it is pushed out from the transportation device and then to tip it, so that the tray tips onto a stack of trays.

Embodiment 13: The cleaning device according to one of the preceding embodiments, furthermore comprising at least one controller, wherein the controller is designed to identify the prespecified type of washware on the basis of data from the sensor and to actuate the slide in a corresponding manner.

Embodiment 14: The cleaning device according to one of the preceding embodiments, wherein the sensor comprises at least one sensor selected from the group consisting of: a camera; a light barrier; a button; a switch, in particular an electromechanical switch; a mechanical-pneumatic switch; a tilting lever.

Embodiment 15: The cleaning device according to one of the preceding embodiments, furthermore comprising at least one transfer device which is arranged at one end of the outlet region, wherein the transfer device is designed to automatically remove washware other than the washware of the prespecified type from the transportation device.

Embodiment 16: The cleaning device according to the preceding embodiment, wherein the transfer device has at least one device selected from the group consisting of a gripping means, a suction means, a chute.

Embodiment 17: The cleaning device according to one of the preceding embodiments, wherein the cleaning device comprises at least one dishwasher.

Embodiment 18: The cleaning device according to the preceding embodiment, wherein the dishwasher is selected from the group consisting of: a rack conveyor dishwasher, a flight-type dishwasher, a hood-type dishwasher, a pass-through dishwasher.

Embodiment 19: The cleaning device according to one of the preceding embodiments, wherein the cleaning chamber is configured at least partially as a cleaning tunnel.

Embodiment 20: The cleaning device according to the preceding embodiment, wherein the cleaning device has at least two cleaning zones in the cleaning tunnel, wherein the transportation device is designed to transport the washware sequentially through the cleaning zones.

Embodiment 21: The cleaning device according to the preceding embodiment, wherein the cleaning zones comprise at least two zones selected from the group consisting of: a pre-clearing zone, a wash zone, a pump final rinse zone, a fresh water final rinse zone; a drying zone.

A method for cleaning washware, comprising the following method steps:

I. providing a cleaning device according to one of the preceding embodiments;
II. receiving the washware on the transportation device;
III. transporting the washware through the cleaning chamber in the transportation direction;
IV. applying at least one cleaning liquid to the washware in the cleaning chamber by means of the application device;
V. identifying at least one prespecified type of washware using the at least one sensor; and
VI. pushing the washware of the prespecified type out of the transportation device transversely to the transportation direction by means of the slide.

BRIEF DESCRIPTION OF THE FIGURES

Further details and features of the invention can be found in the following description of exemplary embodiments, in particular in conjunction with the dependent claims. In this case, the respective features can be implemented on their own or severally in combination with one another. The invention is not limited to the exemplary embodiments. The exemplary embodiments are schematically illustrated in the figures. The same reference numerals in the individual figures denote elements which are the same or have the same function or correspond to one another in terms of their functions.

Specifically.

DESCRIPTION OF THE EXEMPLARY EMBODIMENTS

Figure 1:
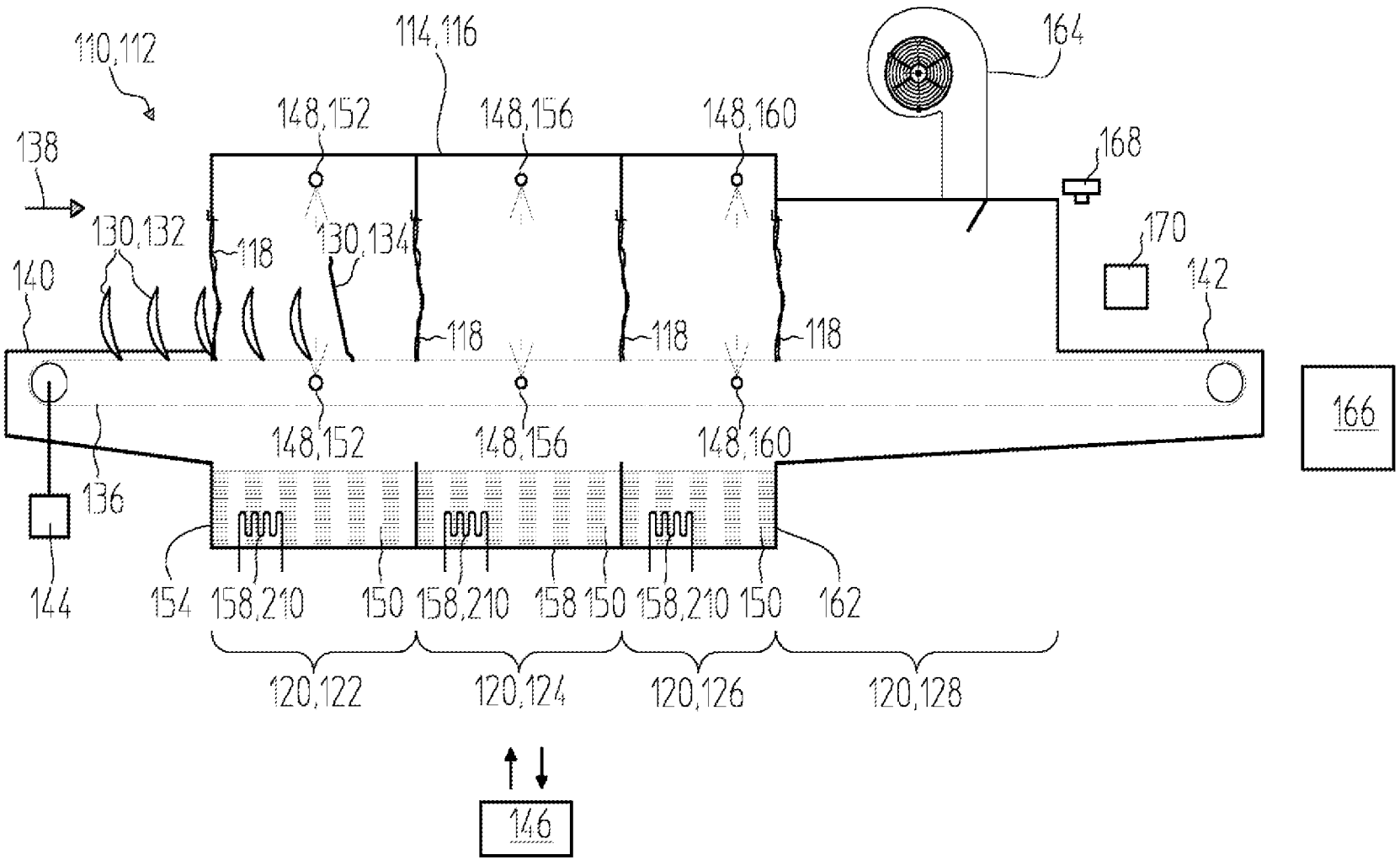
FIG. 1 shows a sectional illustration of an exemplary embodiment of a cleaning device.

FIG. 1 shows a sectional illustration of an exemplary embodiment of a cleaning device 110 from the side. In this exemplary embodiment, the cleaning device 110 is a pass-through dishwasher 112. Reference can be made, for example, to DE 10 2004 046 758 A1, DE 10 2007 053 381 B3 or DE 10 2009 035 668 A1 for possible refinements of pass-through dishwashers of this kind which can be modified and/or added to according to the invention. However, other refinements are also possible in principle.

In the illustrated exemplary embodiment, the cleaning device 110 has by way of example a cleaning chamber 114 in the form of a cleaning tunnel 116. In particular, the cleaning tunnel 116 can be subdivided into a plurality of zones 120, also called cleaning zones, by separating curtains 118, wherein a pre-clearing zone 122, a dishwashing zone 124, a final rinse zone 126 and a drying zone 128 are provided by way of example in the illustrated exemplary embodiment. The final rinse zone 126 can for example once again be subdivided into a pump final rinse zone and a fresh water final rinse zone. A different configuration of the zones 120 is also possible.

In the illustrated exemplary embodiment, washware 130, for example in the form of crockery 132 and trays 134, is conveyed through the cleaning tunnel 116 in a transportation direction 138 by means of at least one transportation device 136. For this purpose, the cleaning device 110 can be configured for example as a flight-type dishwasher or as a rack conveyor dishwasher. For example, at least one inlet region 140 at which the washware 130 is placed onto the transportation device 136 and at least one outlet region 142 at which the cleaned washware 130 can be removed can be provided. Accordingly, the transportation device 136 can comprise for example at least one belt and/or at least one link chain. Other refinements are also possible. The transportation device 136 can comprise for example at least one drive 144 which can be actuated by a controller 146 for example.

At least one cleaning liquid 150 can be applied to the washware 130 by means of at least one application device 148 in the zones 122, 124 and 126. To this end, a pre-clearing zone nozzle system 152 can be provided in the pre-clearing zone 122 for example, which pre-clearing zone nozzle system can be fed with cleaning liquid 150 from a pre-clearing tank 154 for example via a pump, not illustrated in FIG. 1, and a line system, not illustrated. A dishwashing zone nozzle system 156 can be provided in the dishwashing zone 124 for example, which dishwashing zone nozzle system can be fed with cleaning liquid 150 from a dishwashing tank 158 for example via a pump, likewise not illustrated, and a line system, likewise not illustrated. At least one rinse nozzle system 160 can be provided in the final rinse zone 126, which can be configured in a unipartite or else multipartite manner, for example, which rinse nozzle system can be fed with heated fresh water and/or with rinse fluid from a rinse tank 162.

After passing through the zones 122, 124 and 126, the washware 130 can then enter the drying zone 128 in which hot air can be applied to the washware 130 for example by means of a fan 164 in order to accelerate the drying of the washware 130.

The outlet region 142 is arranged downstream of the cleaning chamber 114 in the transportation direction 138, so that the cleaned washware 130 can be removed from the transportation device 136 in the outlet region 142. For example, the cleaned washware 130 can be separated according to type and can be fed manually or automatically to one or more storing devices 166.

In order to at least partially assist and preferably to at least partially automate the removal of the washware 130 and the sorting of said washware, the cleaning device 110 has at least one sensor 168 for identifying at least one prespecified type of washware 130. For example, this at least one prespecified type of washware 130 can comprise trays 134, so that trays 134 can be looked for in a targeted manner in the washware which reaches the outlet 142. For example, trays 134, as are symbolically shown in FIG. 1, can be transported upright through the cleaning chamber 114. However, a different refinement is also possible in principle. The sensor 168 can comprise a camera for example. Furthermore, an image identification system can also be present for example. The sensor 168 can be coupled to the controller 146 and/or can also be wholly or partially integrated into the controller 146, or the controller 146 can be wholly or partially integrated into the sensor 168. Different refinements are possible.

Furthermore, the cleaning device 110 whitewashes at least one slide 170 which is merely symbolically indicated in FIG. 1 and the functioning of which is explained further below with reference to FIG. 2. The slide 170 is movable for example in a direction perpendicular to the plane of the drawing in FIG. 1 and is designed to automatically push the washware 130 of the prespecified type from the transportation device 136 transversely to the transportation direction 138.

Figure 2:
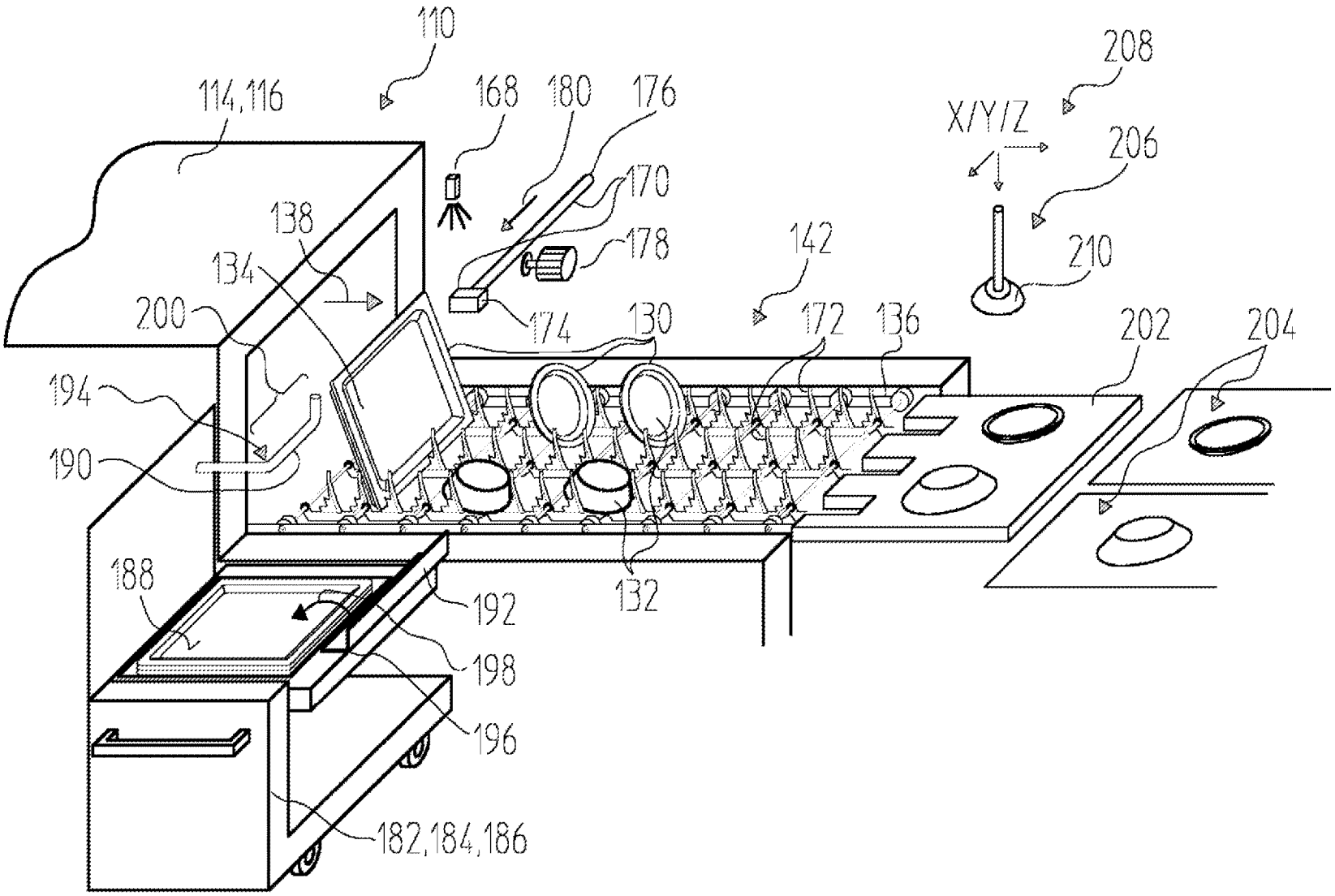
FIG. 2 shows a perspective partial illustration of an outlet region of the cleaning device according to FIG. 1.

FIG. 2 illustrates a perspective partial illustration of one example of the functioning of the slide 170 and also possible refinements of removal of the washware 130 from the outlet region 142. Said figure shows the outlet region 142 of the cleaning device 110, which outlet region is arranged downstream of the cleaning chamber 114 in the transportation direction. It can be seen in said figure that the transportation device 136 can have for example a plurality of fingers 172, also called transportation fingers, into which the washware 130 can be inserted. For example, plates can be transported upright, and trays 134 can also be transported for example upright through the cleaning chamber 114.

In this exemplary embodiment, reference is made by way of example to a refinement in which the sensor 168 is designed to automatically identify trays 134 as the specific type of washware 130. If, for example, the sensor 168 identifies a tray 134, the slide 170 can be automatically operated, for example by the controller 146. For example, the slide 170 can have a head 174, a push rod 176 and a drive 178 for linearly propelling the push rod 176 and therefore the head 174, which is connected to the push rod 176, in a pushing direction 180 transversely to the transportation direction 138. For example, the slide 170 can be arranged at a height at which only trays 134 are pushed out, whereas lower-height washware 130, such as crockery 132 for example, is not pushed out at the same time.

The cleaning device 110 can furthermore have at least one receiving device 182 for receiving the prespecified type of washware 130. As illustrated in FIG. 2, this receiving device 182 can be arranged for example next to the transportation device 136 in the outlet region 142. In particular, the receiving device 142 can contain, as shown in FIG. 2, a tray stacker 184, in particular a tray stacking trolley 186. In particular, the tray stacker 184 can have, as shown in FIG. 2, at least one spring-mounted support area 188 on which the washware 130 of the prespecified type can be stacked. Owing to the spring mounting of the support area 188, the same height for transferring the washware onto the tray stacker can always be provided, irrespective of the number of trays stacked.

The receiving device 182 can optionally be configured in such a way that the orientation of the washware 130 is changed by the slide 170 as the prespecified type of washware 130 is pushed out from the transportation device 136. For example, the receiving device 182 can have at least one first guide rail 190 and at least one second guide rail 192 between which the washware 130 of the prespecified type can be guided. For example, the first guide rail 190 can support a rear side of the tray 134, and the second guide rail 192 can support a front bottom edge of the tray 134. For example, the second guide rail 192 can be configured, as shown in FIG. 2, as a bracket. The first guide rail 190 can have for example a bent portion 194 at which the rear-side supporting of the tray 134 by the first guide rail 190 changes as the tray 134 is pushed onto the receiving device 182 in the pushing direction 180, so that the tray 134 can tip and can tip either directly onto the support area 188 or onto a stack of trays already located on the support area 188. This tipping process can optionally be assisted by way of for example the second guide rail 192 being configured in a movable manner. For example, the second guide rail 192 can have a hinge 196 along which the second guide rail 192 can be pivoted in a tipping direction 198 in order to assist tipping of the tray 134. In general, the first guide rail 190 and the second guide rail 192 can be designed to hold a tray 134 upright for a first section 200 as it is pushed out from the transportation device 136 and then to tip said tray, so that the tray 134 tips onto a stack of trays. The first section 200 can extend for example from an outermost end of the first guide rail 190 to the bent portion 194. Instead of trays 134, other types of washware 130 can also be prespecified and pushed out in a similar manner to the trays 134 illustrated in FIG. 2.

The prespecified type of washware 130 which is to be pushed from the transportation device 136 by the slide 170 can be stored for example in the controller 146. For example, the type of washware can be prespecified by a user and can also be variable. As an alternative, the type of washware can also be permanently prespecified, for example by way of only trays 134 being pushed from the transportation device 136 by the slide 170. Instead of a single slide 170, a plurality of slides 170 can also be provided.

After the washware 130 of the prespecified type is pushed out transversely to the transportation direction 138, for example other washware 130 can remain on the transportation device 136, as illustrated by way of example in FIG. 2. This washware can be pushed for example from the transportation device 136 onto a storage device 202 and/or transportation devices 204 or manually removed from the transportation device 136. As an alternative or in addition, at least one transfer device 206 can also be provided, as indicated in FIG. 2. The said transfer device can have for example at least one positioning device 208 in order to position for example at least one gripping means and/or at least one suction means 210. For example, types of washware 130 other than the at least one prespecified type can be automatically or at least semi-automatically removed from the transportation device 136 and/or from the storage device 202 wholly or partially by the transfer device 206.

LIST OF REFERENCE SIGNS

110 Cleaning device
112 Pass-through dishwasher
114 Cleaning chamber
116 Cleaning tunnel
118 Separating curtain
120 Zone
122 Pre-clearing zone
124 Dishwashing zone
126 Final rinse zone
128 Drying zone
130 Washware
132 Crockery
134 Tray
136 Transportation device
138 Transportation direction
140 Inlet region
142 Outlet region
144 Drive
146 Controller
148 Application device
150 Cleaning liquid
152 Pre-clearing zone nozzle system 152
154 Pre-clearing tank
156 Dishwashing zone nozzle system
158 Dishwashing tank
160 Rinse nozzle system
162 Rinse tank
164 Fan
166 Storing device
168 Sensor
170 Slide
172 Finger
174 Head
176 Push rod
178 Drive
180 Pushing direction
182 Receiving device
184 Tray stacker
186 Tray stacking trolley
188 Support area
190 First guide rail
192 Second guide rails
194 Bent portion
196 Hinge
198 Tipping direction
200 First section
202 Storage device
204 Transportation device
206 Transfer device
208 Positioning device
210 Suction means

The invention claimed is:

1. A cleaning device for cleaning washware, comprising at least one cleaning chamber with at least one application device for applying at least one cleaning liquid to the washware in the cleaning chamber, furthermore comprising at least one transportation device for transporting the washware through the cleaning chamber in a transportation direction, wherein the cleaning device has at least one outlet region, which is arranged downstream of the cleaning chamber in the transportation direction, for removing the washware from the transportation device, wherein the cleaning device furthermore has at least one sensor for identifying at least one prespecified type of washware, wherein the cleaning device has at least one pusher, wherein the pusher is designed to push the washware of the prespecified type from the transportation device in a direction transverse to the transportation direction upon the sensor identifying the washware of the prespecified type, wherein the pusher is positioned at a height where only the washware of the prespecified type is pushed by the pusher.

2. The cleaning device as claimed in claim 1, furthermore comprising at least one receiving device which is arranged next to the transportation device transversely to the transportation direction, wherein the cleaning device is designed to push the washware of the prespecified type onto the receiving device by means of the pusher.

3. The cleaning device as claimed in claim 2, wherein the washware of the prespecified type can be stacked in the receiving device.

4. The cleaning device as claimed in claim 2, wherein the cleaning device furthermore has at least one guide, wherein the guide is designed to feed the washware of the prespecified type to the receiving device with a prespecified orientation.

5. The cleaning device as claimed in claim 4, wherein the guide is designed to turn the washware of the prespecified type from a first orientation on the transportation device to a second orientation in the receiving device.

6. The cleaning device as claimed in claim 1, wherein the transportation device has at least one device selected from the group consisting of: a conveyor belt; a transportation chain; a roller transportation device; a pawl drive.

7. The cleaning device as claimed in claim 1, wherein the washware of the prespecified type comprises trays.

8. The cleaning device as claimed in claim 7, wherein the transportation device is designed to receive the trays with a non-parallel orientation in relation to a plane of the transportation device.

9. The cleaning device as claimed in claim 8, wherein the transportation device has at least one of a conveyor belt and a link chain, wherein the transportation device has a plurality of receiving fingers, wherein the trays can be inserted into the receiving fingers at an angle of from 60° to 120° in relation to a plane of at least one of the conveyor belt and the link chain, wherein the trays can be inserted into the receiving fingers transversely to the transportation direction.

10. The cleaning device as claimed in claim 7, wherein the cleaning device has at least one tray stacker, wherein the cleaning device has at least one first guide rail and at least one second guide rail, wherein the first and the second guide rail are designed to hold a tray upright for a first section as it is pushed out from the transportation device and then to tip it, so that the tray tips onto a stack of trays.

11. The cleaning device as claimed in claim 1, furthermore comprising at least one controller, wherein the controller is designed to identify the prespecified type of washware on the basis of data from the sensor and to actuate the pusher in a corresponding manner.

12. The cleaning device as claimed in claim 1, wherein the sensor comprises at least one sensor selected from the group consisting of: a camera; a light barrier; a button; a switch; an electromechanical switch; a mechanical-pneumatic switch; a tilting lever.

13. The cleaning device as claimed in claim 1, furthermore comprising at least one transfer device which is arranged at one end of the outlet region, wherein the transfer device is designed to automatically remove washware other than the washware of the prespecified type from the transportation device.

14. The cleaning device as claimed in claim 1, wherein the cleaning device comprises at least one dishwasher.

15. The cleaning device of claim 1, further comprising:

a receiving device which is arranged next to the transportation device in the direction traverse to the transportation direction; and wherein the pusher is designed to push the washware of the prespecified type from the transportation device in the direction transverse to the transportation direction onto the receiving device.

16. The cleaning device of claim 1, wherein:

the prespecified type of washware includes a tray;

the transportation device has a plurality of receiving fingers;

the receiving fingers are configured to position the tray in an upright position on a long edge of the tray that is in the direction transverse to the transportation direction;

the sensor is configured to identify the tray;

the pusher is configured to push the tray in the direction transverse to the transportation direction upon the sensor identifying the tray; and the receiving fingers are positioned to allow the long edge of the tray to slide in the direction transverse to the transportation direction when pushed by the pusher.

17. The cleaning device of claim 16, further comprising:

a receiving device configured to receive the tray when pushed by the pusher; and wherein the receiving device has at least one guide rail extending in the direction transverse to the transportation direction to guide the tray into the receiving device when pushed by the pusher.

* * * * *